US007389890B1

(12) United States Patent
Hampsten

(10) Patent No.: US 7,389,890 B1
(45) Date of Patent: Jun. 24, 2008

(54) COMPOSITE CRYOGENIC PROPELLANT TANK INCLUDING AN INTEGRATED FLOATING COMPLIANT LINER

(75) Inventor: Kenneth R. Hampsten, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 687 days.

(21) Appl. No.: 10/841,187

(22) Filed: May 10, 2004

(51) Int. Cl.
*F17C 1/06* (2006.01)

(52) U.S. Cl. ..... 220/560.07

(58) Field of Classification Search ..... None
See application file for complete search history.

(56) References Cited

U.S. PATENT DOCUMENTS 1,092,999 A * 4/1914 Kinnear ..... 220/4.06
4,495,775 A * 1/1985 Young et al. ..... 62/46.3
2004/0026431 A1* 2/2004 Jones ..... 220/588

* cited by examiner

*Primary Examiner*—Stephen J. Castellano
(74) *Attorney, Agent, or Firm*—James M. Skorich

(57) ABSTRACT

A tank suitable for containing cryogenic propellant includes an inner liner structure comprised of two layers forming a gap. An intermediary layer comprised of micro-particles is disposed in the gap formed between the two layers of the inner liner structure. A structural overwrap layer covers the inner liner structure in a manner that enables the inner liner structure to float within the structural overwrap layer. The inner floating liner structure can be formed by two thin interlocking (outer and inner) shell s formed in a cylindrical, end dome geometry. The inner and outer shells are both sectioned beyond the tank midpoints. The micro-particles can be comprised of PTFE. An outer structural overwrap comprised of graphite/epoxy covers the double shell liner. A pair of separately fabricated polar bosses seal against the inner of the two interlocking floating liner shells are then each bonded to the tank, fittings, and piping.

14 Claims, 3 Drawing Sheets

COMPOSITE CRYOGENIC PROPELLANT TANK INCLUDING AN INTEGRATED FLOATING COMPLIANT LINER

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE INVENTION

The present invention is generally related to storage tanks. More particularly, the present invention is related to lightweight, self-sealing cryogenic propellant storage tanks.

BACKGROUND OF THE INVENTION

Historically, propellant tanks for liquid rockets have been manufactured using metal. Recently, composite tanks made using, for example, graphite or epoxy have been used for storable propellants such as kerosene and as high pressure tanks in order to reduce their structural weight, and thus the overall weight of dependent systems.

Liquid oxygen (LOX), a cryogenic propellant, is one of the most efficient oxidizers from a mass and performance aspect. Other cryogenic propellant fuels include liquid hydrogen and liquid methane. There has been no successful demonstration of cryogenic propellants such as LOX in a high-pressure composite tank. Most composite tank failures using LOX can be attributed to microcracking of the composite resin matrix due to large differences in the coefficient of thermal expansion (CTE) between fibers and the resin used to manufacture such tanks. Also, there are no known resins that won't microcrack under these conditions.

SUMMARY OF THE INVENTION

What is needed is a storage tank for use with cryogenic propellants that can withstand thermal expansion and overcome microcracking.

The present inventor proposes a tank design for storing cryogenic propellants. The present invention can withstand thermal contraction normally encountered with the use of cryogenic propellants and related matrix microcracking.

It is a feature of the present invention to provide an integrated floating complaint liner design for tanks that captures a layer of polytetrefluoroethylene (PTFE), or other LOX compatible materials such as Teflon®, formed as micro-particles to fill in cracks as they are formed.

It is another feature of the present invention to provide an integrated floating complaint liner design for tanks that intentionally decouples composite tank cryogenic liquid containment from the structural pressure vessel.

It is another feature of the present invention to provide an integrated floating complaint liner design for tanks that includes a micro-particle sandwich wherein the micro-particles will compress under load between the floating liner and outer tank wall, resulting in a compacted tank seal.

It is yet another feature of the present invention to provide an integrated floating complaint liner design for tanks wherein each micro-particle operates to form a collective hermetical seal under pressure between the tank wall and floating compliant liner and collectively enables the tank system to survive high numbers of deep thermal cycles.

It is still another feature of the present invention to provide an integrated floating complaint liner design for tanks wherein the micro-particles are comprised of PTFE, which has a low coefficient of friction and facilitates particle redistribution, or equilibrium as voids are filled between the liner and the tank wall.

A tank suitable for containing cryogenic propellant can include an inner liner structure further comprised of two layers forming a radial gap. The intermediary layer can be comprised of LOX compatible materials, such as PTFE, formed as micro-particles disposed in the gap formed between the two layers of the inner liner structure. The structural overwrap layer will cover the inner liner structure in a manner that enables the inner liner structure to float within the structural overwrap layer. The inner floating liner structure is formed with two thin interlocking (outer and inner) composite shells, consisting of a cylindrical section with typical elliptical end dome geometries. The inner and outer shells are both sectioned beyond the tank midpoints. A pair of separately fabricated polar bosses seal against the inner of the two interlocking floating liner shells, typically bonded to each inner shell piece with a toughened epoxy.

The outer shell also performs as the inner tool mold surface for the final outer structural overwrap fabrication process. The outer overwrap reacts all pressure and external forces required by the specific tank design application, relying on the inner tank sandwich to provide the hermetic seal. This is accomplished by allowing the double wall sandwich structure to move in relation to the outer structural overwrap. The shells and overwrap can be made from graphite/epoxy and fabricated on a filament-winding machine.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawings and descriptive matter in which preferred embodiments of the invention are illustrated.

DETAILED DESCRIPTION OF THE INVENTION

As previously mentioned, experiments have shown that carbon fiber/epoxy materials microcrack when used with cryogenic propellants due to large differences in the coefficient of thermal expansion between the carbon fiber and epoxy matrix. Acknowledging this limitation, the present inventor developed an integrated floating compliant liner design for tanks.

Figure 1:
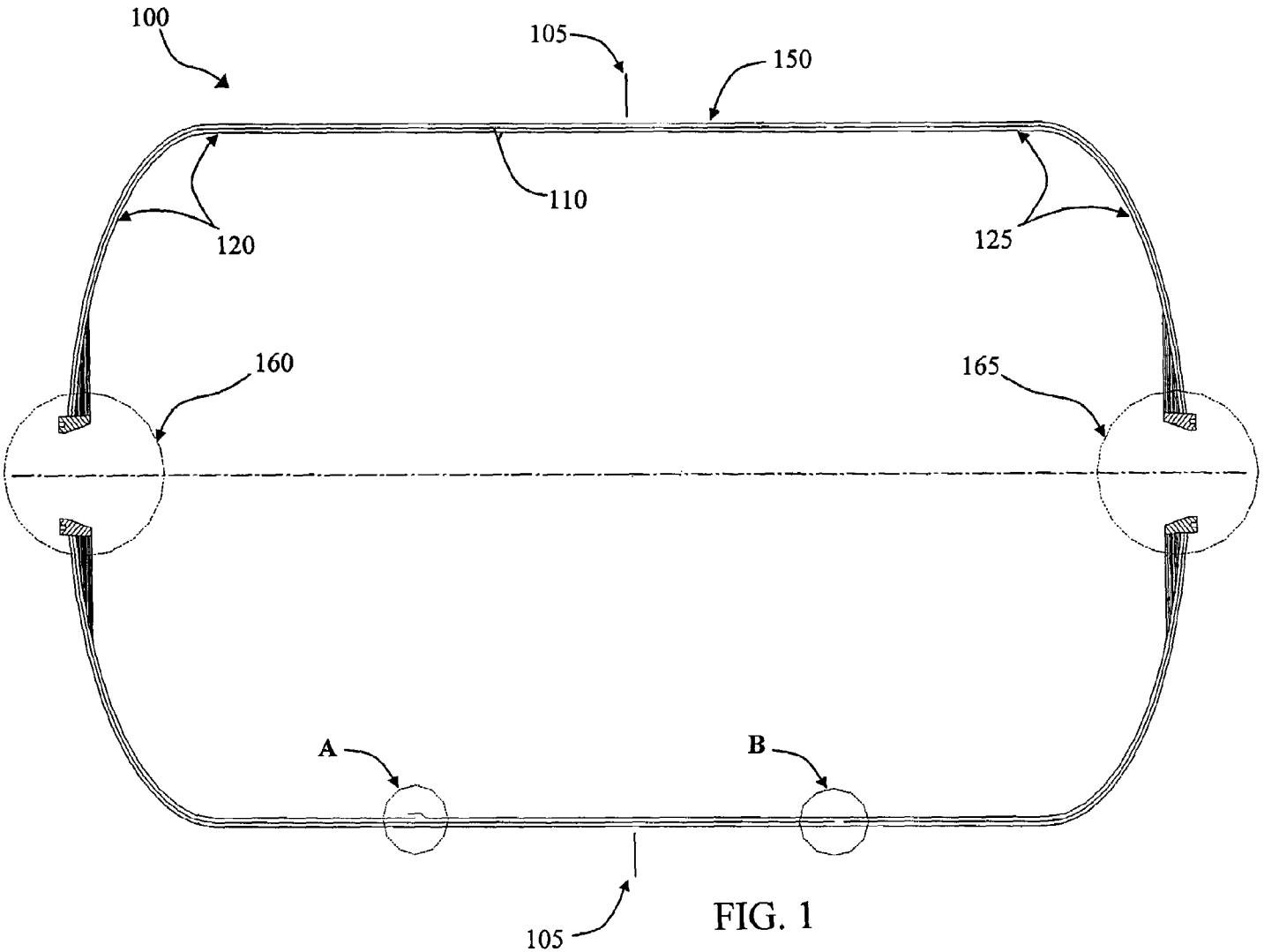
FIG. 1 illustrates a cross section view of a tank suitable for containing cryogenic propellant in accordance with features of the present invention.

Referring to FIG. 1, it is a feature of the present invention to provide a tank 100 that includes an inner floating liner structure 110. The inner floating liner structure 110 can include interlocking shells 120/125 comprised of carbon fiber/epoxy and formed in a cylindrical, end dome geometry. The interlocking shells 120/125 can be sectioned to provide surface 130 and inner 135 layers that overlap and extend beyond the tank's 100 midpoints 105, resulting in interconnections as shown at locations A and B. A pair of separately fabricated polar bosses 160/165 seal against the inner of the two interlocking floating liner shells 120/125. The inner floating liner structure 110 is then enclosed in an outer structural overwrap 150, which operates as a pressure vessel.

Figure 2:
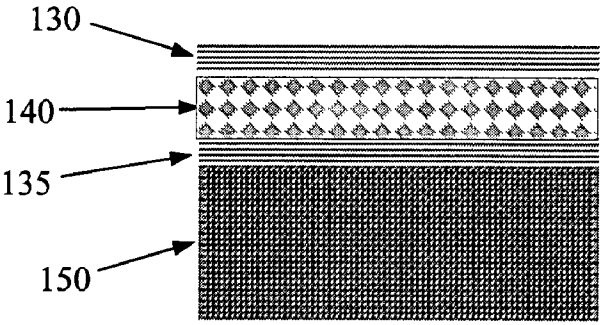
FIG. 2 illustrates a close in view of the layers forming the tank wall including the inner and outer liner structure, Teflon powder matrix, and overwrap layer.

A close in view of the layers forming the entire tank wall is shown at FIG. 2. The inner floating liner structure 110 is shown to include surface layer 130 and inner layer 135 assembled with a cryogenically compatible, inert intermediary micro-particle layer 140 disposed between the layers 130/135. Micro-particles used for the micro-particle layer 140 can range in size from 1-10 microns in diameter. The outer structural overwrap 150 is then shown enclosing the inner floating liner structure 110 assembly.

The micro-particles can be comprised of commercially available polytetrafluoroethylene—PTFE—sold under the Teflon® trademark by DuPont or the DyNeon™ trademark by 3M. PTFE is a vinyl polymer. Polytetrafluoroethylene is made from the monomer tetrafluoroethylene by free radical vinyl polymerization. PTFE is available in micropowders, powders and particles. It should be appreciated that other liquid oxygen compatible materials can be used in place of PTFE to perform as the micro-particles described herein. Reference to PTFE, Teflon® or DyNeon™ should not be interpreted as a limitation over the scope of the present invention.

When PTFE powders were subjected to Liquid Nitrogen temperatures during testing at the Air Force Research Laboratory, Space Vehicles Directorate, the material remained as a complaint powder with no apparent change in viscosity. Furthermore, particles cannot react tensile (only compressive) load that would be the result of very large differences between the cryogenic thermal expansion properties of the carbon fiber/epoxy shell and the PTFE. Finally, PTFE is routinely used in the cryogenics industry as a sealing material and is chemically compatible with all current cryogenic launch vehicle propellants.

Figure 3:
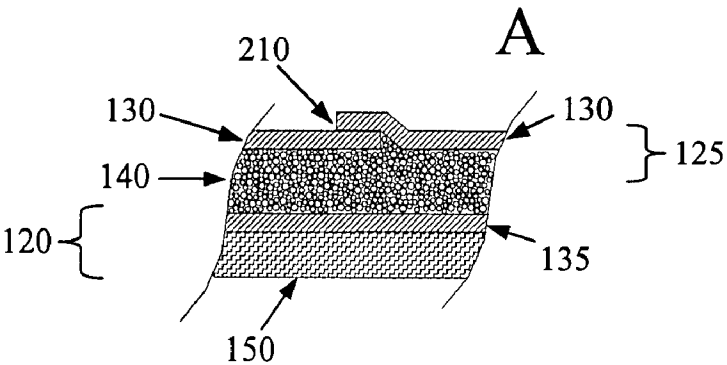
FIG. 3 illustrates an overlapping connection for the inner liner to prevent loss of Teflon powder into the tank volume.

The overlapping connection 210 for the surface layer 130 associated with the two shells 120/125 shown at location A in FIG. 1 is illustrated in more detail as a blown up illustration in FIG. 3. Referring to FIG. 3, surface layer 130 associated with shell 125 is shown overlapping the surface layer 130 associated with shell 125. Micro-particles 140 are shown creating a seal where the surface layers 130 overlap. Inner layer 135 is shown sandwiching the micro particles 140, and overwrap layer 150 is shown disposed outside of inner layer 135.

Figure 4:
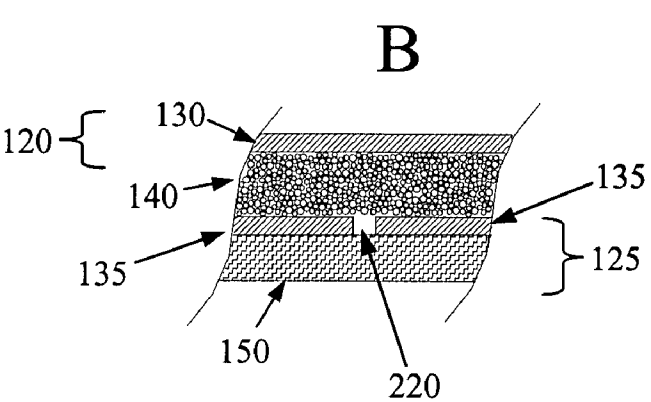
FIG. 4 illustrates a gap formed in the outer liner, underneath the bonded structural overwrap.

An exaggerated inner layer gap 220 as shown at location B in FIG. 1 is illustrated in more detail as a blown up illustration in FIG. 4. Referring to FIG. 4, an inner circumferential liner gap 220 is shown between inner layer 135 associated with shell 120 and inner layer 135 associated with shell 125. It can be appreciated that the micro-particles will fill-in the void forming the inner layer gap 220 that will normally extend around the entire circumference of the tank 110. Surface layer 130 is shown sandwiching the micro particles 140 opposite the inner layer 135, and overwrap layer 150 is shown disposed outside of inner layer 135.

Figure 5:
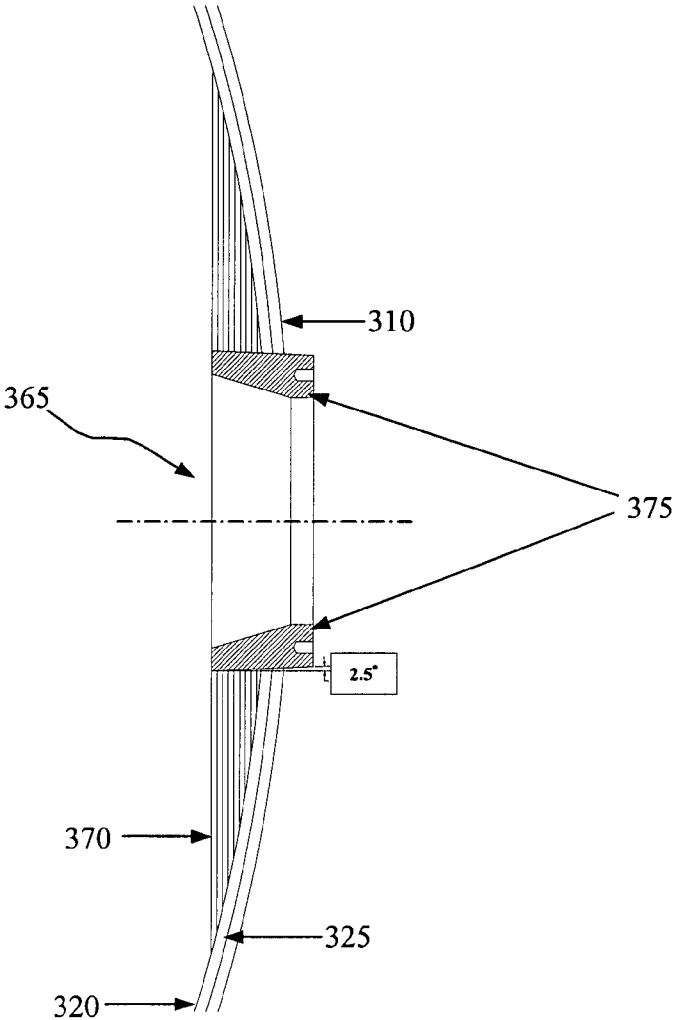
FIG. 5 illustrates a blown up detail illustration of the tank polar boss region.

Referring to FIG. 5, a blown up detail illustration of a polar bosses 165 is provided. Polar boss 365 is generally shown sealed against the inner surface 320 of shell liner 325. The inner ring 375 and reinforcing structure 370 for polar boss 365 is constructed of a carbon fiber/epoxy laminate structure. Tank plumbing connections (not shown), would typically be attached to the boss via a bolted flange assembly.

During fabrication, two graphite/epoxy shells can be produced using permanent, non-collapsible mandrels, which can reduce tooling costs. After the shells have been wound and cured over their respective mandrels, they can be sectioned (cut) and removed from the mandrels. The shells are assembled together with the inner surface layer forming an overlap. The assembled double shell inner floating liner structure 110 can then serve as the mandrel for the second component, an outer structural overwrap 140, which operates as a pressure vessel. The outer structural overwrap can comprise of graphite/epoxy wound over the double shell liner. The structural overwrap is allowed to bond to the outer double shell structure during fabrication.

The resulting system is an integrated floating compliant liner design for tanks that captures a layer of micro-particles to fill in and seal cracks as they are formed. The invention can be used as expendable and reusable launch vehicle propellant tanks, to include potential use on the Air Force's evolved Expendable Launch Vehicle (EELV), Space Operations Vehicle (SOV), and future NASA reusable Launch Vehicle (RLV) programs. The invention can also be used as satellite tankage, especially those that will require long term, on-orbit storage of cryogenic propellants, including Space Based Infrared (SBIR) Low, Space Based Laser (SBL), and Next Generation Space Telescope (NGST) program satellites. Terrestrial and Airborne applications that require light weight cryogenic structures, including the Airborne Laser (ABL) program and future booster air launch subsystems such as launch tubes and propellant transfer tankage can also benefit from the invention.

The invention claimed is:

1. A tank for containing cryogenic liquid, comprising:

an inner liner comprised of two interlocking shells, wherein the shells are comprised of carbon fiber/epoxy;

the inner liner having a cylindrical, end dome geometry and a mid-point;

the two shells having complementary circumferential openings extending beyond the midpoint;

each of the shells being comprised of an inner layer and an outer layer, with a gap lying between the inner and outer layers;

micro-particles being disposed in the gap;

the inner layers overlapping each other;

a circumferential gap being located between the two shells in the outer layers;

an overwrap layer covering the inner liner so that the inner liner structure is able to float within and relative to the overlap layer.

2. The tank of claim 1 wherein;

the micro-particles are cryogenically compatible; and the circumferential gap is for inserting the micro-particles in the gap lying between the inner and outer layers.

3. A tank suitable for containing cryogenic propellant, comprising:

two double wall shells comprised of graphite/epoxy and including inner and outer layers, the two shells formed in a cylindrical, end dome geometry having complementary circumferential openings, wherein the shell's openings extend beyond the tank's midpoint and wherein the two shells are assembled as a double shell structure including overlapping inner surface layers and wherein the outer layers create a gap;

cryogenically compatible micro-particles inserted between the shells' inner and outer layers through the gap created between the shells' outer layers; and an outer structural overwrap layer comprised of graphite/epoxy, said structural overwrap layer covering the double wall shell structure in such a manner as to enable the double wall structure to float within the outer structural overwrap.

4. The tank of claim 3, wherein the micro-particles are comprised of PTFE particles ranging in size from 1-10 microns in diameter.

5. The tank of claim 4, wherein the PTFE particles range in size from 1-10 microns in diameter.

6. The tank of claim 3, further comprising a pair of polar bosses each sealed against the inner layer of the two interlocking floating liner shells through openings formed in the center of the end dome of each shell.

7. The tank of claim 6, wherein the pair of polar bosses are also sealed against the overwrap layer surrounding the openings.

8. A method for making a tank suitable for containing cryogenic propellant, comprising the steps of:

fabricating two double wall shells comprised of graphite/epoxy and including inner and outer layers, the two shells formed in a cylindrical, end dome geometry;

sectioning the two double wall shells where the inner and outer shells extend beyond the tank's midpoint;

assembling the two shells as a double shell structure including an overlapping inner surface layer and wherein the outer layers create a gap;

inserting cryogenically compatible micro-particles between the inner and outer layers through the gap; and fabricating an outer structural overwrap layer comprised of graphite/epoxy, said structural overwrap layer covering the double wall shell structure to enable the double wall structure to float within the outer structural overwrap.

9. The method of claim 8, wherein the overwrap is fabricated by being wound over the double shell liner while preventing it from bonding to the outer double shell structure.

10. The method of claim 8, wherein the micro-particles are comprised of PTFE particles ranging in size from 1-10 microns in diameter.

11. The method of claim 8 wherein the double wall shells are produced using permanent, non-collapsible mandrels wherein the shells are wound and cured over their respective mandrels.

12. The method of claim 8, further comprising the step of producing a pair of separately fabricated polar bosses, wherein said bosses will seal against the inner of the two interlocking floating liner shells.

13. The method of claim 12, wherein the bosses are each constructed of an Invar ring bonded into a silica/epoxy laminate structure.

14. The method of claim 12, wherein each boss is bonded to the inner surface layer and the overwrap layer.

* * * * *